US009005054B2

(12) United States Patent
Flater

(10) Patent No.: US 9,005,054 B2
(45) Date of Patent: Apr. 14, 2015

(54) GOLF BALL TEEING TONGS

(71) Applicant: Anders Harald Flater, Highland Park, IL (US)

(72) Inventor: Anders Harald Flater, Highland Park, IL (US)

(73) Assignee: Anders H. Flater, Highland Park, IL (US)

( * ) Notice: Subject to any disclaimer, the term of this patent is extended or adjusted under 35 U.S.C. 154(b) by 26 days.

(21) Appl. No.: 13/987,942

(22) Filed: Sep. 18, 2013

(65) Prior Publication Data

US 2015/0080152 A1 Mar. 19, 2015

(51) Int. Cl.
*A63B 57/00* (2006.01)

(52) U.S. Cl.
CPC ..... *A63B 57/0037* (2013.01)

(58) Field of Classification Search
CPC ..... A63B 57/0006; A63B 57/0018; A63B 2057/0025; A63B 57/0037
See application file for complete search history.

(56) References Cited

U.S. PATENT DOCUMENTS

| | | | | | |
|---|---|---|---|---|---|
| 3,312,468 | A * | 4/1967 | Lynch | 473/133 |
| 3,669,427 | A * | 6/1972 | Curtis | 294/19.2 |
| 4,013,295 | A * | 3/1977 | Baughman | 473/286 |
| 4,616,826 | A * | 10/1986 | Trefts | 473/133 |
| 4,949,961 | A * | 8/1990 | Milano | 473/133 |
| 5,503,394 | A * | 4/1996 | Mauck et al. | 473/386 |
| 5,669,646 | A * | 9/1997 | Fiocca et al. | 473/386 |
| 5,672,121 | A * | 9/1997 | Miller | 473/386 |
| 5,707,303 | A * | 1/1998 | Berkowitz et al. | 473/386 |
| 8,529,379 | B1 * | 9/2013 | Faircloth | 473/386 |
| 2003/0203772 | A1 * | 10/2003 | Paine | 473/386 |
| 2004/0029653 | A1 * | 2/2004 | Whitehill et al. | 473/386 |

* cited by examiner

*Primary Examiner* — Steven Wong

(57) ABSTRACT

A golf ball teeing tongs comprising a pair of levers, spring hinged in an end pivot point, their free ends adaptable to receive and hold a golf ball and tee, an adjustable pressure disk attached to the end of two connectively moving swing arms, which are fastened inside the members to move in concert with their opening and closing, thus exerting a straight back and forth movement on the adjustable pressure disk, causing a clamping force to be exerted, when manually closing the members, so as to hold a golf ball and tee in a rigid grip for positioning into the ground, at which point the spring pressure is manually released to open the members, which action lifts the adjustable pressure disk from the golf ball to allow removal of the tongs.

12 Claims, 3 Drawing Sheets

GOLF BALL TEEING TONGS

BACKGROUND OF THE INVENTION

The present invention relates, in general, to the teeing up of golf balls and is intended to promote safety and joy of the game for golfers who find it difficult to make a full bend down to the ground level. The normal procedure is to hold the golf ball against the head of the tee in one hand and then bend down to insert the stem of the tee into the ground to a desired position of the golf ball. This maneuver requires a steady hand to insure that the ball does not fall off the tee head. Present devises are hampered by their heavy metal rod construction, inaccurate ball on tee placement, tee off inconvenience and storage problems.

Thus it would be desired to provide a golf ball teeing device which would be light in weight, unobtrusive and with secure ball on tee placement on the ground.

SUMMARY OF THE INVENTION

In summary, the present invention is intended to provide a useful light weight and unobtrusive tool to aid golfers to tee up and retrieve golf balls. It comprises a tongs of two opposing members, attached in a spring loaded hinge joint, with their open ends adapted to hold a golf ball against the head of a tee. The inside of the members contain two interconnected swing arms attached to an adjustable pressure disk with a curved face conforming to the outer surface of a golf ball. The members are pushed open by a spring, preferably located in the hinge joint area, which movement forces the swing arms to back up the adjustable pressure disk to accommodate the loading of a golf ball and tee. The manual closing of the members forces the swing arms to return the adjustable pressure disk to clamp a loaded golf ball on top of a tee head. The tongs may be locked into a closed storage position when the flat snap spring, attached to one member, is wedged by finger pressure into a hole in the opposing member. The tongs is unlocked by manually pressing the members together which action snaps the flat spring out of its retaining hole. The hinge joint contains a holder adapted for hooking the tongs on the golfer's pocket or golf bag. The open ends of the members may contain provisions to store a tee and a swing ground pin, the latter to secure the upright storage position of the tongs on the ground. Further objects and advantages of the present invention will become apparent in the remainder of this disclosure.

DETAILED DESCRIPTION OF THE PREFERRED EMBODIMENT OF THE INVENTION

Figure 1:
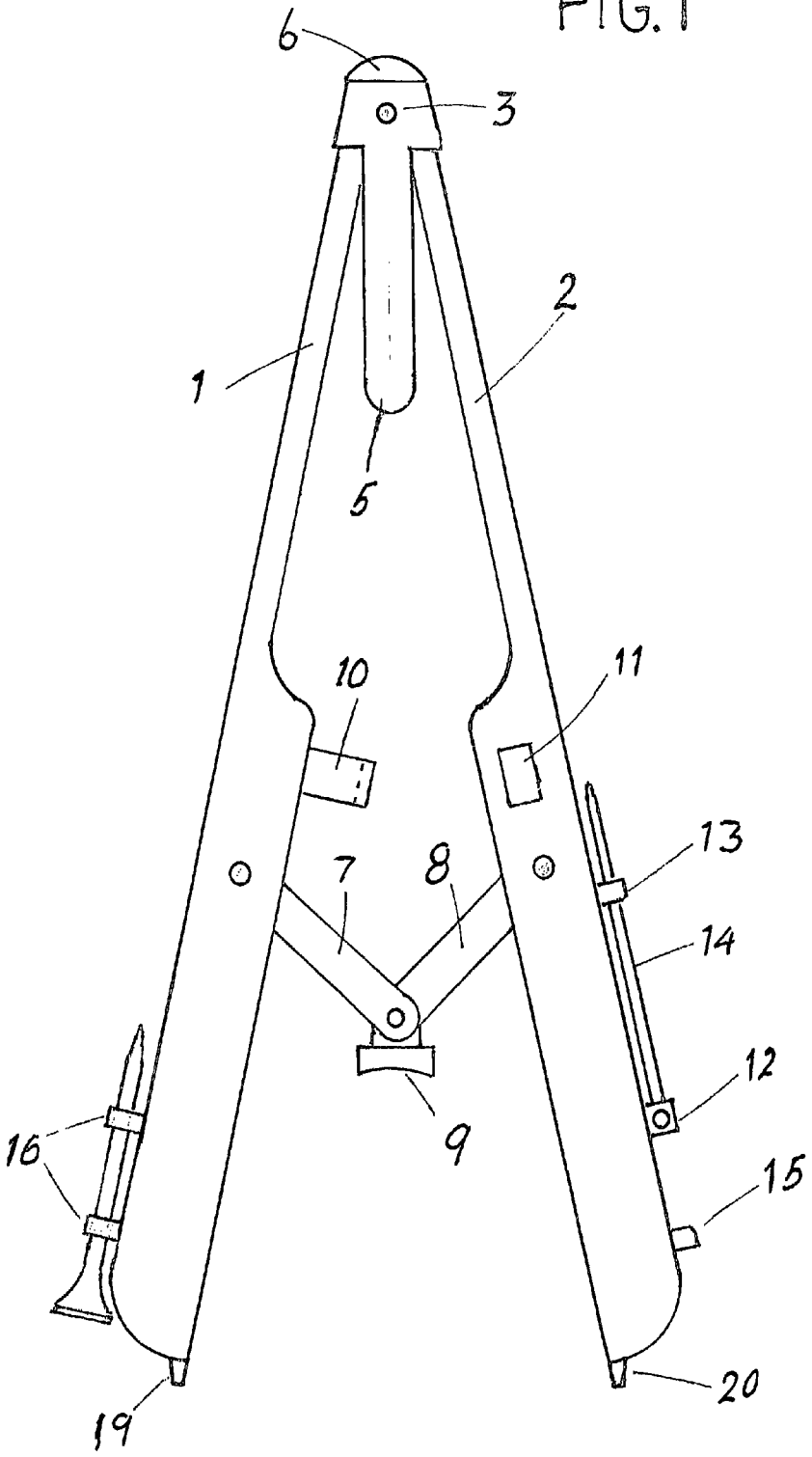
FIG. 1 is a side elevational view of a tongs of this invention with the members in an open position.
Figure 2:
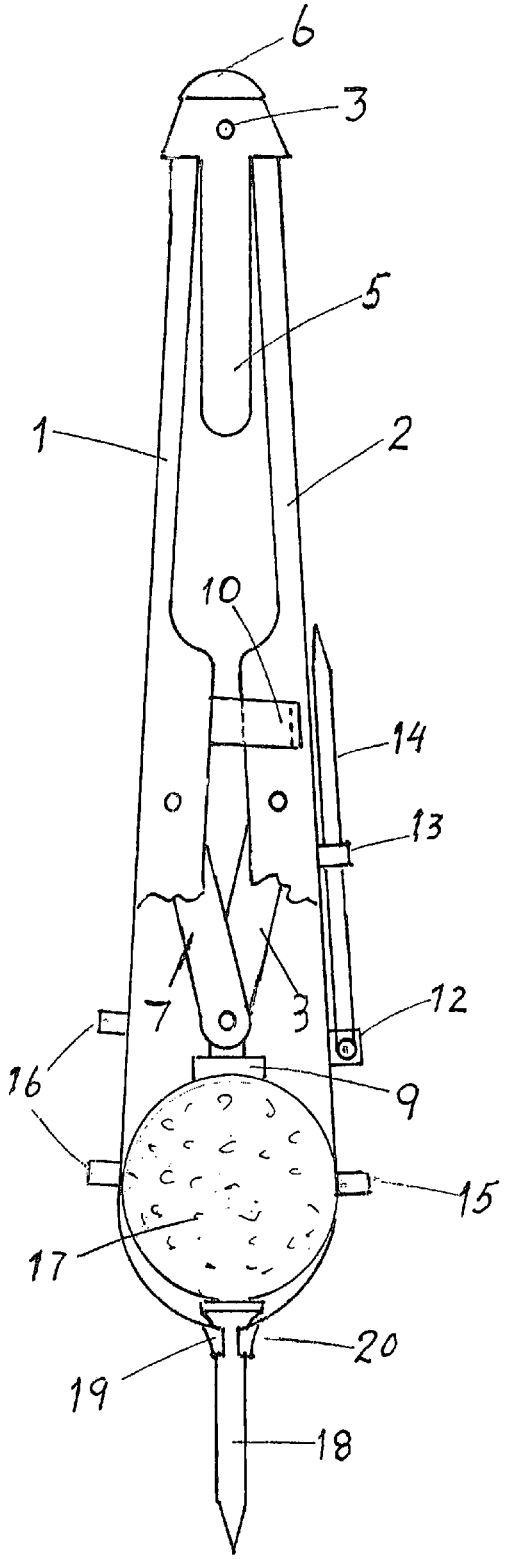
FIG. 2 is a fragmentary side elevational view of a tongs of this invention in a closed loaded position with a golf ball and tee.
Figure 3:
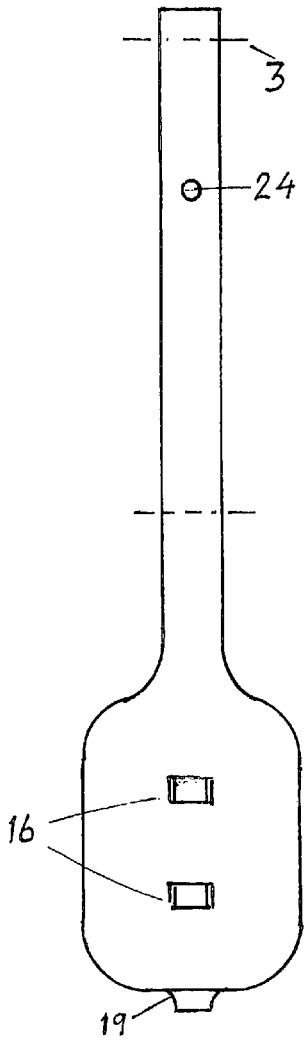
FIG. 3. Is a top elevational view of a member of this invention.
Figure 5:
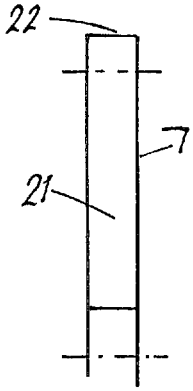
FIG. 5 is a top view of a swing arm of this invention.
Figure 6:
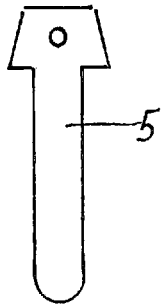
FIG. 6 is a top view of a holder of this invention.
Figure 7:
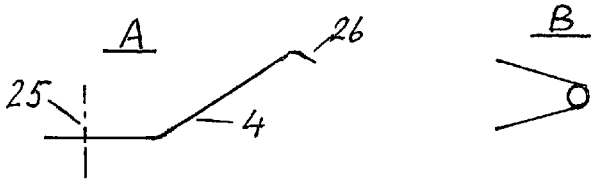
FIG. 7 is a side view of a spring of this invention (A) and a side view of an alternative spring (B).
Figure 8:
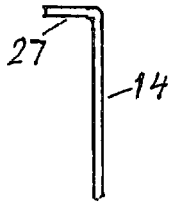
FIG. 8 is a side view of a ground pin of this invention.
Figure 9:
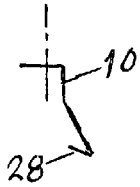
FIG. 9 is a side view of a snap spring of this invention.
Figure 4:
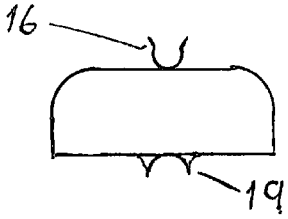
FIG. 4 is a frontal view of a member of this invention.
Figure 10:
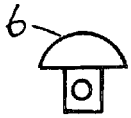
FIG. 10 is a side view of a top cover of this invention
Figure 11:
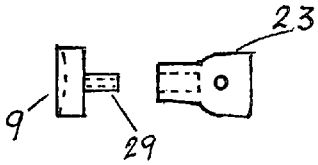
FIG. 11 is a side view of an adjustable pressure disk assembly of this invention.

With reference to FIG. 1, it can be seen in overview that the golf ball teeing tongs of this invention includes two members 1, and 2, which are interconnected in a pivot point 3, containing a spring 4, here not shown, to force the members 1 and 2 into an open position, holder arm 5, and top end 6, swing arms 7, and 8, containing adjustable pressure disk 9. The flat spring 10, in member 1 will snap into cut 11, in member 2 so as to close the members in a storage position. The holder arm 5, attached to the pivot point 3, is adapted to hook the tongs on the golfer's pocket or golf bag. The top surface of member 2 contains swing attachment 12, snap configurations 13, and 15, to secure ground pin 14, which, when swung into its extended position, insures upright storage of the tongs on the ground. The top surface of member 1 may contain provisions 16, for retaining a tee for storage. FIG. 2 depicts the golf ball teeing tongs in a loaded closed position whereby the swing arms 7 and 8 containing adjustable pressure disk 9 is clamping the golf ball 17, against tee 18, positioned in slots 19, and 20, in the ends of members 1 and 2 so as to effectuate a secure tee up. The swing arms contain a back plate 21, with edge 22, positioned to contact extension 23, of adjustable pressure disk 9 so as to insure its straight upright position while moving back and forth in a linear fashion. The adjustable pressure disk assembly, shown in FIG. 11, is expandable to increase golf ball seating pressure on the tee by finger turning the disk head containing screw threaded pin 29, in extension 23. The spring 4 is contained in member 1 by fastening means through holes 24, and 25, so that its top end 26, will force member 2 into an open position. An alternative spring may be attached to the pin contained in pivot point 3. The end 27, of ground pin 14, is attached to swing attachment 12. The flat spring 10, fastened to member 1 contains bent edge 28, to secure lock up with cut 11, in member 2.

Materials to Produce the Embodiment of the Golf Ball Teeing Tongs

Include light sheet steel for stamping of the major parts, alternatively formed by molded plastic material, and hardened steel wire for the spring and ground pin. Finally, although the teeing tongs discloses a certain arraignment of spring and linkages, it should be understood that other types of linkages and springs may be used for pivotal arrangement of the gold ball teeing tongs of this invention.

METHODS OF USE

The methods of use of the hand held golf ball teeing tongs of this invention, which includes two pivotally members to grip and clamp a golf ball against a tee head, is to enable a golfer to tee up the ball, for an opening golf shot, without bending down to the ground level. In the process the members open by spring pressure so as to enable the golfer to place the golf ball inside one of the open members and insert the tee in its upward oriented slot and then manually close the members. This forces the adjustable pressure disk to clamp the golf ball against the tee head in a rigid position, as secured by a clockwise finger tightening turn of the disk, for easy tee-up to the desired height. At this point, the golfer releases the hand pressure to open the members, which action lifts the adjustable pressure disk from the golf ball to allow free removal of the tongs, either side ways or straight up, while leaving the golf ball on the tee head ready to play. The teeing tongs may then conveniently be hooked onto the golfers back pocket for the ensuing golf swing or placed on the ground in an upright position by the extension of the ground pin. After having addressed the ball, the golfer may use the tongs to retrieve the grounded tee, to be snapped onto one member, and then hook the tongs to the back pocket or golf bag. Accordingly, the tongs is light in weight and of convenient height so as not to inconvenience the movement of the golfer.

What is claimed is:

1. A golf ball teeing tongs comprising: a pair of members hinged in a spring loaded pivot point to force them into an open position, their free ends adapted to receive and hold a golf ball and tee;

a pair of connected swing arms attached to the members so as to move in concert with their opening and closing;

an adjustable pressure disk connected to the swing arms in order to clamp a loaded golf ball onto the head of a tee held by the members in their close position;

a holder arm to carry the teeing tongs while not in use;

a device to hold the members in a closed storage position;

a swing pin, while in its extended position, will keep the teeing tongs in an upright position on the ground;

a provision for storing a tee on the outside surface of a member.

2. The golf ball teeing tongs of claim 1, wherein the members are hardened stampings made from thin steel material.

3. The golf ball teeing tongs of claim 1, wherein the members are from 10 to 15 inches long.

4. The golf ball teeing tongs of claim 1, wherein the free ends of the members are bent up with slots tapered inwards to hold the stem of a tee.

5. The golf ball teeing tongs of claim 1, wherein the adjustable pressure disk consist of two parts interconnected through screw threads.

6. The golf ball teeing tongs of claim 1, wherein the spring device is a flat compression spring located outside the member pivot point.

7. The golf ball teeing tongs of claim 6, wherein the spring device is a torsion spring located in the member pivot point.

8. The golf ball teeing tongs of claim 1, wherein the device to hold the tongs in a close storage position is a flat spring fastened to one member.

9. The golf ball teeing tongs of claim 8, wherein the flat spring has a bend edge to catch the opposing member, by finger pressure, before reaching the full member closing position.

10. The golf ball teeing tongs of claim 9, wherein the flat spring will snap out of its locking position by manually pressing the members closer.

11. The golf ball teeing tongs of claim 1, wherein the members contain fastening clips for a tee and swing pin.

12. The golf ball teeing tongs of claim 1, wherein the tongs is lite and suitable to be hooked onto a golfer's pocket.

* * * * *